US005577852A

United States Patent [19]

To

[11] Patent Number: 5,577,852

[45] Date of Patent: Nov. 26, 1996

[54] RING BINDER MECHANISM

[75] Inventor: Chun Y. To, Kowloon, Hong Kong

[73] Assignee: World Wide Stationery Manufacturing Co. Ltd., Hong Kong

[21] Appl. No.: 329,464

[22] Filed: Oct. 26, 1994

[51] Int. Cl.[6] ..... B42F 3/04

[52] U.S. Cl. ..... 402/31; 402/36

[58] Field of Search ..... 402/26, 31, 36

[56] References Cited

U.S. PATENT DOCUMENTS

| | | | |
|---|---|---|---|
| 5,106,222 | 4/1992 | D'Amore | 402/26 |
| 5,286,128 | 2/1994 | Gillum | 402/31 X |

FOREIGN PATENT DOCUMENTS

| | | | |
|---|---|---|---|
| 2004816 | 4/1979 | United Kingdom | 402/31 |
| 2004816 | 7/1982 | United Kingdom . | |

*Primary Examiner*—Willmon Fridie, Jr.

*Attorney, Agent, or Firm*—Wood, Herron & Evans, P.L.L.

[57] ABSTRACT

A ring binder mechanism having two carrier rails which are arranged in a resilient casing member and which bear against each other, the angle formed between said carrier rails changing from an obtuse to an acute angle and vice versa during opening and closing of pairs of half rings associated with said carrier rails, wherein the casing member has a connection point in at least one end of the casing for connecting the casing to a support and the casing member is strengthened by at least one channel or bead extending from within a recess about the connection point to a point between the recess and the pair of half rings closest to the recess.

6 Claims, 3 Drawing Sheets

RING BINDER MECHANISM

This invention relates to ring binder mechanism.

In particular this invention relates to a ring binder mechanism having carrier rails which are arranged in a resilient casing member, the angle formed between said carrier rails changing from an obtuse to an acute angle and vice verca during opening and closing the half rings associated with said carrier rails.

When ring binder mechanisms are assembled, it is common for the ends of the casing member to be bent or otherwise damaged during feeding into an assembly machine as a result of the weakness of the end portion of the casing. The damage often results in the distortion of the connection points or rivet holes and/or jamming of the machine. Strengthening of the casing is described by use of beads or ribs in UK Patent No. GB2004816B in order to aid the assembly of the ring binder mechanism. However, the problem of weakness in the ends of the casing was not solved by the bead/rib arrangement described in GB2004816B.

Accordingly, this invention broadly consists in a ring binder mechanism having two carrier rails which are arranged in a resilient casing member and which bear against each other, the angle formed between said carrier rails changing from an obtuse to an acute angle and vice versa during opening and closing of pairs of half rings associated with said carrier rails, wherein the casing member has a connection point in at least one end of the casing for connecting the casing to support and the casing member is strengthened by at least one channel or ridge extending from within a recess about the connection point to a point between the recess and the pair of half rings closest to the recess.

The channel(s) or ridge(s) increases the strength of the casing member so that the end portion which must be fed into the assembly machine does not suffer any, or suffers only minimal, deformation. By virtue of this arrangement it is now possible for assembly of such a ring binder mechanism to be effected with a substantial reduction in damage to the casing.

The sheet metal used for the casing member may also be of smaller thickness, as a thicker sheet of metal is no longer required to provide the casing with sufficient strength.

The invention will now be described in more detail, by way of example, with reference to the drawings in which.

Figure 3:
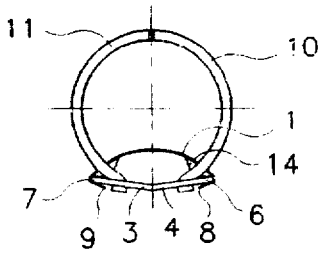
FIG. 3 is cross-section through line B—B on FIG. 1.
Figure 4:
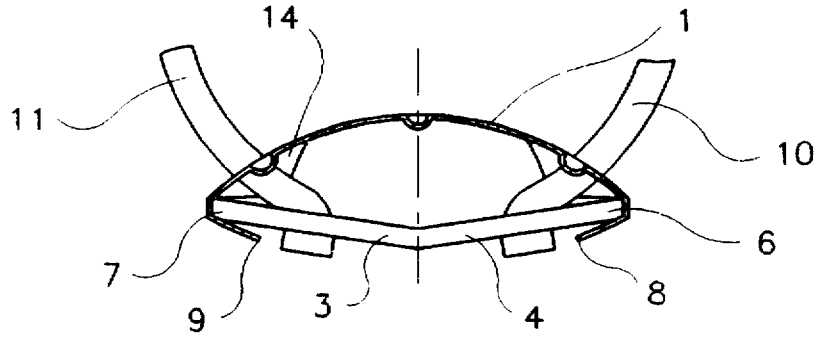
FIG. 4 is a section through the line A—A on FIG. 2.

FIGS. 3 and 4 of the drawings show that the casing member 1 of a ring binder mechanism 2 which accommodates two carrier rails 3 and 4 in such a way that the carrier rails 3 and 4 bear against each other in a central plane while their outer longitudinal edges 6 and 7 engage behind downwardly bent edge portions 8 and 9 of the casing member 1.

Each of the ring bars 3 and 4 carries half rings 10, 11, which are shown in the closed position in the Figures.

Openings 14 are provided in the casing member 1 in the region of the half rings 10 and 11.

As soon as the half rings 10 and 11 are moved towards each other by hand, they will snap quickly into the closed position by virtue of the casing member 1 which comprises resilient material and which can be connected at its ends through connection points such as rivet holes 13 to a cover, protective binder or the like, and by transmission of the spring force to the carrier rails 3 and 4. In the closed position the rails 3 and 4, as viewed from the underside, enclose an angle of more than 180° whereas in the open position they form an angle of less than 180°.

Figure 1:
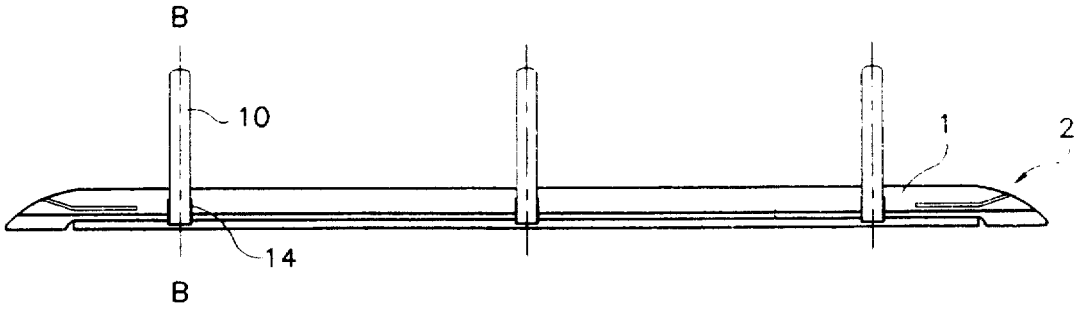
FIG. 1 is a side view of a preferred embodiment of a ring binder mechanism of the present invention.
Figure 2:
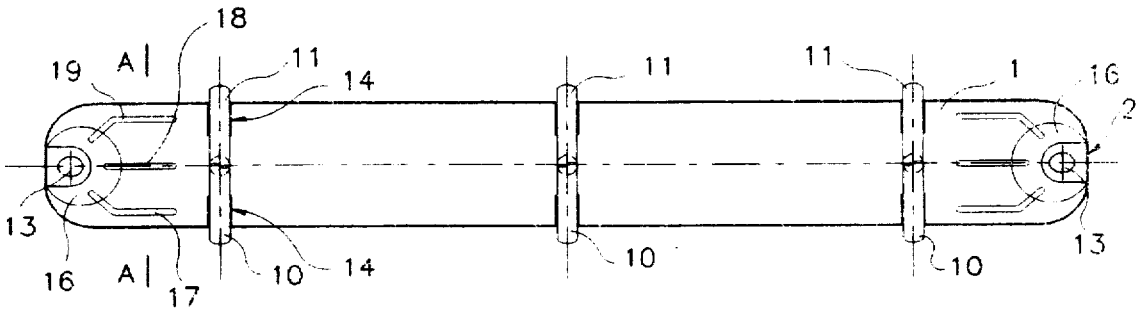
FIG. 2 is a plan view of the ring binder mechanism of FIG. 1.

As shown in FIGS. 2, the upwardly curved casing member 1 may have channels or ridges 17, 18, 19, at the end of the casing 1. Each channel or ridge preferably extends from one of the recesses 16 surrounding each rivet hole 13 to a point between the recess 16 and the set of half rings 10, 11, closest to the recess 16. For extra strength, the three channels or ridges 17, 18 and 19 at their rivet recess ends point towards the rivet hole 13, and at the other end run parallel to each other and extend longitudinally along the casing.

Figure 5:
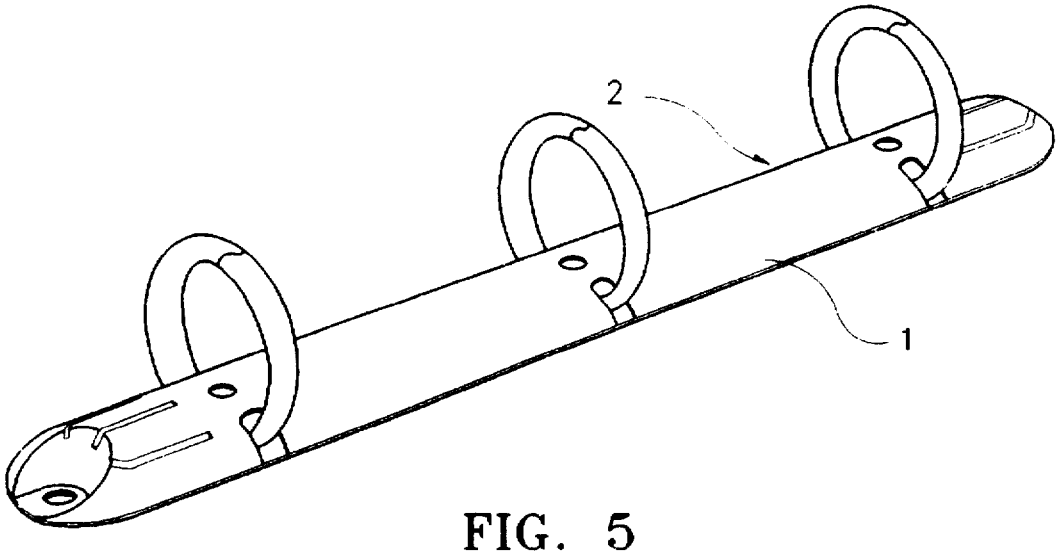
FIG. 5 is a perspective view of the ring binder mechanism of FIG. 1.
Figure 6:
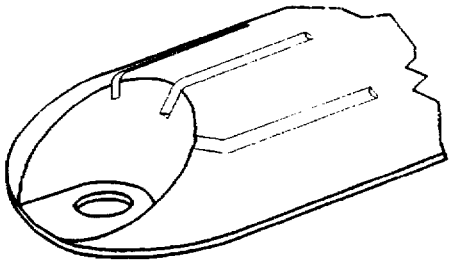
FIG. 6 is a detail perspective view of the end of the ring binder mechanism of FIG. 5 showing the ridges or channels.

Thus, as can be seen in FIGS. 2, 5 and 6, the central channel or ridge 18 would be substantially along one line and the outer two channels or ridges 17, 18, 19, bend at one end towards the rivet hole 13. Preferably between one quarter and one half of the length of the channels or ridges points toward the rivet hole.

Figure 7:
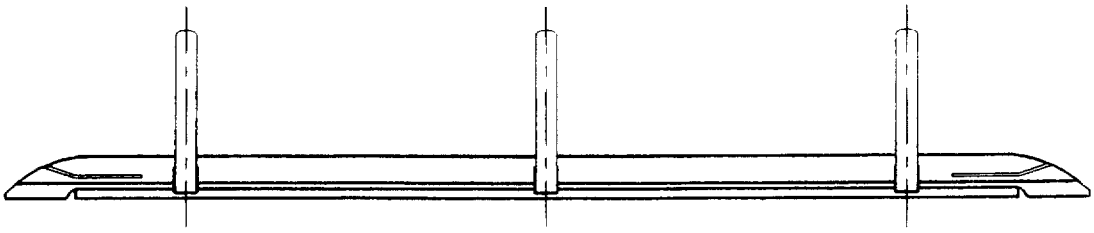
FIG. 7 is a side view of a second embodiment of a ring binder mechanism of the present invention.
Figure 8:
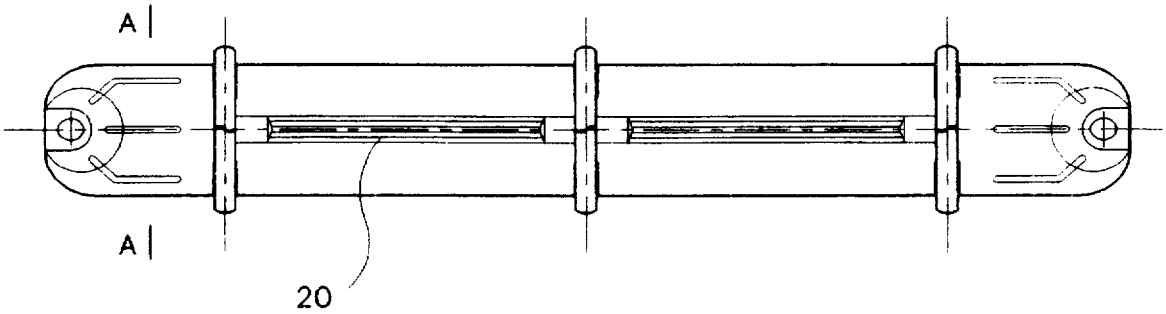
FIG. 8 is a plan view of the ring binder mechanism of FIG. 7.
Figure 9:
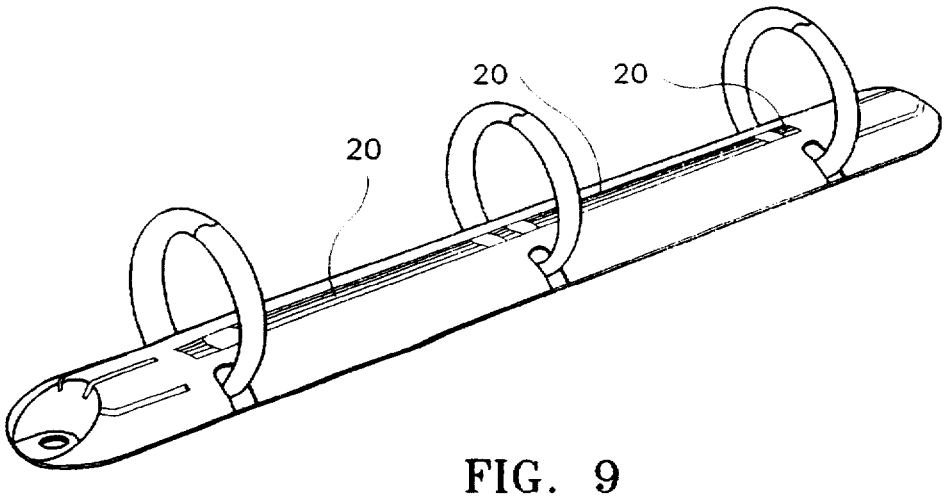
FIG. 9 is a perspective view of the ring binder mechanism of FIG. 7.

A further embodiment of the ring binder mechanism is shown in FIGS. 7–9 in which the ring binder mechanism is further provided with a central channel or ridge 20, which may extend continuously or discontinuously along the casing 1, to further strengthen the casing so that it can be gripped and held by a machine component, without being deformed, in order to provide for the carrier rails 3,4 together with their corresponding half rings 10, 11 to be inserted from the longitudinal edge of the casing member by machine in automated manufacture.

The ends of the curved casing member 1, are so strengthened by the channels or ridges 17, 18 and 19 that they can be fed into an assembly machine with a substantially reduced likelihood that they will be damaged in the process.

The combination of channels or ridges 17, 18 and 19 and channel or ridge 20 provides an extremely strong and versatile casing adapted particularly to automated manufacture of ring binder mechanisms.

The above describes preferred embodiments of the present invention, variations in which may be made without departing from the scope of the invention as defined in the accompanying claims.

For example, there may be only one channel or ridge or there may be a plurality ridges, providing channels or ridges are, preferably, evenly spaced about the centre of the casing. There may be a plurality of channels or ridges 20, which may be placed parallel to the longitudinal axis of casing 1 in addition to or instead of channel 20.

The connection points need not be rivet holes, but may be any conventional connection arrangement such as prongs or merely a point at which the mechanism is adhered to a support.

I claim:

1. A ring binder mechanism having two carrier rails which are arranged in a resilient casing member and which bear against each other, the angle formed between said carrier rails changing from an obtuse to an acute angle and vice versa during opening and closing of pairs of half rings associated with said carrier rails, wherein the casing member has a connection point in at least one end of the casing for connecting the casing to a support and the casing member is strengthened by at least one channel or ridge extending from within a recess about the connection point and ending at a point between the recess and the pair of half rings closest to the recess.

2. A ring binder mechanism as claimed in claim 1, wherein the casing member is strengthened by three channels or ridges, one extending centrally along the longitudinal axis of the casing and the other two extending either side of, and at least in part, parallel to, the central channel or ridge.

3. A ring binder mechanism as claimed in claim 1 or claim 2 wherein the end(s) of the channel(s) or ridge(s) extending from within the recess point(s) towards the connection point in the recess and the other ends of the channel(s) or ridge(s) extend(s) parallel to the longitudinal axis of the casing.

4. A ring binder mechanism as claimed in claim 3, wherein between 25% and 50% of the length of each channel or ridge extends in a direction towards the connection point.

5. A ring binder mechanism as claimed in any one of claims 1–4 wherein the casing is further provided with at least one channel or ridge which extends in a longitudinal direction in the area of the casing under or between the pairs of half rings.

6. A ring binder mechanism as claimed in claim 5, wherein the casing is provided with a central channel or ridge.

* * * * *

UNITED STATES PATENT AND TRADEMARK OFFICE

CERTIFICATE OF CORRECTION

PATENT NO. : 5,577,852

DATED : November 26, 1996

INVENTOR(S) : Chun Yuen To

It is certified that error appears in the above-identified patent and that said Letters Patent is hereby corrected as shown below:

At Col. 1, line 51, please insert "cross" before --section--.

Signed and Sealed this

Thirteenth Day of May, 1997

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,577,852

DATED : November 26, 1996

INVENTOR(S) : Chun Y. To

It is certified that error appears in the above-indentified patent and that said Letters Patent is hereby corrected as shown below:

At Column 2, lines 67 to Column 3, line 1, please delete "from an obtuse to an acute angle and vice versa".

At Column 3, line 3 please add --a recess containing-- after "has".

At Column 3, line 4 after "support" please add --on a cover member of a ring binder--.

At Column 3, line 6 please delete "a" and add --the--.

Signed and Sealed this

Fifteenth Day of July, 1997

Bruce Lehman

*Attest:*

BRUCE LEHMAN

*Attesting Officer*

*Commissioner of Patents and Trademarks*